United States Patent [19]

Cherry

[11] 4,400,951

[45] Aug. 30, 1983

[54] COMBINATION FOOD FREEZER/DINING TABLE

[76] Inventor: Kenneth A. Cherry, 1 Shorehaven Rd., East Norwalk, Conn. 06855

[21] Appl. No.: 312,802

[22] Filed: Oct. 19, 1981

Related U.S. Application Data

[63] Continuation-in-part of Ser. No. 140,957, Apr. 17, 1980, abandoned.

[51] Int. Cl.[3] ..... F25D 23/12

[52] U.S. Cl. ..... 62/258; 312/277

[58] Field of Search ..... 312/223, 236, 277; 62/258, 440, 458, 297, 331

[56] References Cited

U.S. PATENT DOCUMENTS

| | | | |
|---|---|---|---|
| 845,707 | 2/1907 | Randolph | 62/258 X |
| 1,351,097 | 8/1920 | Cook | 62/258 |
| 1,492,428 | 4/1924 | Cook | 62/258 X |
| 1,718,407 | 6/1929 | Buergermeister | 62/258 X |
| 1,729,491 | 9/1929 | Rygl | 312/277 X |
| 1,840,645 | 1/1932 | Tibbot | 62/258 |
| 2,170,717 | 8/1939 | Hull | 62/258 |
| 2,414,061 | 1/1947 | Richard et al. | 62/258 X |
| 2,463,658 | 3/1949 | Thrasher | 62/258 X |
| 2,474,452 | 6/1949 | Amyot | 62/258 X |
| 2,490,494 | 12/1949 | Widman | 62/258 X |
| 2,534,546 | 12/1950 | Dunlap | 62/258 |
| 2,554,290 | 5/1951 | Beckler | 62/258 X |
| 2,756,570 | 7/1956 | Gale | 62/331 |
| 2,895,311 | 7/1959 | Spalvins | 62/258 |

*Primary Examiner*—Lloyd L. King

*Attorney, Agent, or Firm*—Cifelli, Frederick & Tully

[57] ABSTRACT

A combination food freezer/dining table comprises a chest-type food freezer having a table top secured to the lid thereof. The table top overhangs at least one of the exterior walls of the food freezer other than the back wall to adapt the combination food freezer/dining table for placement against the wall of a room, and preferably overhangs all four exterior walls of the food freezer to adapt the food freezer for placement away from the walls of a room. A peripheral protective knee-barrier is removably secured to and spaced apart from the exterior freezer walls which are overhung by the table top, the peripheral protective knee-barrier preventing contact between the exterior walls of the food freezer and a user's knees. In another embodiment, table leaves are hingedly mounted to the freezer side walls, and pivot between a horizontal operative position and a storage position. Secondary side walls are mounted to the freezer side walls to prevent contact therewith. An air-pervious base barrier extends between the lower edges of the exterior food freezer walls and the floor surface on which the food freezer is supported, the air-pervious base barrier providing a restricted air flow which evenly distributes air flow created by operation of the food freezer.

12 Claims, 9 Drawing Figures

COMBINATION FOOD FREEZER/DINING TABLE

BACKGROUND OF THE INVENTION

This application is a continuation-in-part of my copending application Ser. No. 140,957 filed Apr. 17, 1980, now abandoned.

This invention relates to a combination food freezer and dining table, including features adapting a food freezer for this purpose.

Food freezers are capable of storing large amounts of frozen foods. They are generally used in large households to store frozen foods bought at quantity discounts in order to take advantage of sales, etc. They are also useful for storing large items, such as turkeys, which are not readily accepted in combination refrigerator/freezers. Food freezers are also useful appliances for people who cannot shop often and have to buy large amounts of food on each shopping trip, or for people who have food delivered to their residences. In general, more foods are being packed in frozen form, and particularly there are now available many prepackaged frozen foods suitable or quickly prepared meals, including very high quality and sophisticated menu items. Additionally, the capability of quickly preparing frozen foods has increased markedly with the availability and use of microwave ovens.

Perhaps the biggest drawback of food freezers is that they require a substantial amount of space. Freezers are often kept in basements, utility rooms, garages and sometimes in a kitchen if the kitchen is quite large. Thus, the advantages of food freezers are often effectively denied to apartment dwellers, condominium owners, and others who have limited available space. These people are often the ones who have active, busy lifestyles which could benefit from the use of a food freezer, particularly to eliminate the necessity of frequent shopping trips and also to store prepared frozen foods of the type useful in quick preparation of meals.

SUMMARY OF THE INVENTION

It is a principal object of the invention herein to make efficient use of the space required by a food freezer.

It is an additional object of the invention herein to adapt a food freezer to function as the base of a table, including providing for the comfort of persons sitting at the table.

According to the invention herein, a food freezer functions as a base for a dining table. More particularly, table surfaces are mounted to and extend peripherally outward from the food freezer. In one embodiment, a table top is secured to a lid of a chest-type food freezer with the table top extending outwardly from at least one side of the food freezer, whereby space is provided under the overhanging portion of the table top to accomodate users' legs when sitting at the table. If the combination food freezer/dining table is to be used in a room where it may be positioned spaced away from the walls, the table top preferably overhangs on all sides of the food freezer, wherein the people may sit all around the table. If the combination freezer/dining table is to be placed against the wall, the table top preferably overhangs on three sides but does not overhang on the side at which the lid of the food freezer is hinged to its body, whereby the combination food freezer/dining table may be placed against the wall. The tension in the spring loading mechanism of the freezer lid may be increased to compensate for the additional weight of the table top, and counterweights can be added in the table top, if and as required.

The combination food freezer/dining table is also adapted to provide for the comfort of those using it as a table. Some exterior side and end walls of a food freezer can become warm as a result of the operation of the food freezer because the heat coils of the food freezer are generally positioned in contact with these freezer walls and the freezer walls are used to dissipate heat. In order that the user's knees do not contact warm freezer walls, a peripheral decorative knee barrier is mounted to the exterior freezer walls at approximately knee height. The knee-barrier is spaced apart from the freezer walls, so that air flow may occur behind the knee-barrier for heat dissipation purposes. The peripheral decorative knee-barrier is also preferably removably mounted so that it can be taken off for cleaning both the knee-barrier itself and the food freezer side walls behind it.

In another embodiment, table leaves are hingedly mounted to respective side walls of the food freezer, and are adapted to be pivoted to and secured in horizontal orientation extending outwardly from the side walls. The leaves fold into vertical orientation adjacent the side walls when not in use. In this embodiment, a table top is also preferably mounted to the freezer lid itself, but has only a small overhang. A secondary side wall is mounted spaced-apart from the freezer side wall and air flow between the secondary side wall and the freezer side wall achieves heat dissipation.

Another source of potential discomfort is the heat from the freezer compressor, which is usually vented through slots in a recessed kick plate of the freezer. Heated air is expelled by a fan, and creates a substantial flow of warm air. This problem is alleviated by providing a restricted air-pervious barrier about the base of the food freezer, the barrier being adapted to vent the hot air evenly about the base of the freezer and thereby eliminate a localized flow of warm air.

The combination food freezer/dining table requires approximately the same or little more space than a conventional dining table. Accordingly, it can be placed in a dining room, kitchen or other eating area in place of a conventional dining table. A food freezer can thereby be added to a residence without usurping additional floor space. With proper attention to design, the combination food freezer/dining table can be an attractive unit which is satisfactory in its function as a piece of furniture.

Other and more specific objects and features of the invention herein will in part be obvious and will in part appear from a perusal of the following description of the preferred embodiments and the claims together with the drawings.

DRAWINGS

The same reference numerals refer to the same elements throughout the various Figures.

DESCRIPTION OF PREFERRED EMBODIMENTS

Figure 1:
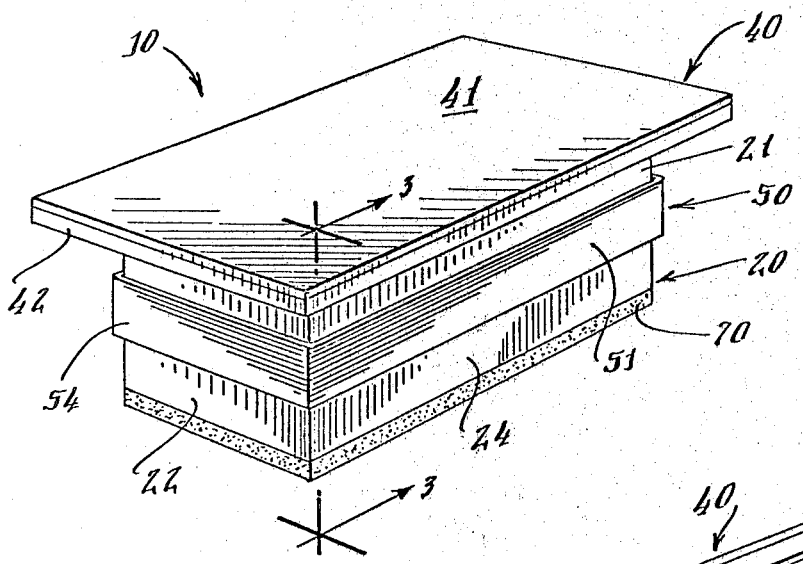
FIG. 1 is a perspective view of a combination food freezer/dining table according to the invention herein.

With reference to FIGS. 1–5, a combination food freezer/dining table 10 according to the invention herein is illustrated. The food freezer/dining table 10 generally comprises a food freezer 20 having a table top 40 secured to the lid thereof, a peripheral protective knee-barrier 50 mounted to the side and end walls of the freezer 20, and an air-pervious kick plate 70 disposed about the base of the food freezer 20. These elements are combined to form a comfortable and attractive dining table with the food freezer acting as the base thereof, whereby the food freezer is accommodated in the space normally utilized by a dining table alone.

The food freezer 20 is of the chest type, having a body 21 and a lid 30. The body 21 has exterior end walls 22 and 23, an exterior front wall 24 and an exterior back wall 25. The body 21 also has corresponding interior walls spaced apart from the foregoing exterior walls, and the interior walls define an open topped cavity 26 for accepting frozen food items. The lid 30 is hinged to the body 21 of the food freezer adjacent the back wall, and pivots from the closed position shown in FIGS. 1, 3 and 4 to the open position shown in FIG. 2 providing access to the freezer cavity 26. The hinge mechanism (not shown) connecting the lid 30 with the body 21 has springs designed to counterbalance the weight of the lid when the lid is open and to bias the lid to its closed position. The outside dimensions of the chest type food freezer are typically about sixty inches long, thirty inches wide and thirty inches high, although the dimensions, of course, vary with the capacity of the food freezer. In general, the food freezer 20 is of the type commonly available on the commercial market, and is modified as hereinafter described as necessary to function as an element of the invention herein.

Figure 2:
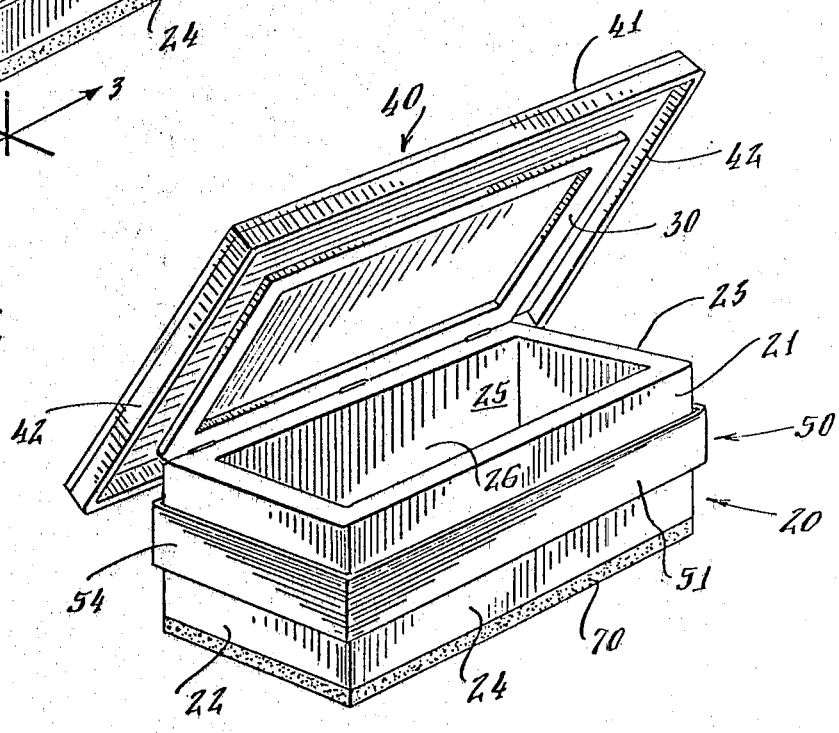
FIG. 2 is a perspective view of the combination food freezer/dining table of FIG. 1 shown open for access to the food storage cavity.
Figure 3:
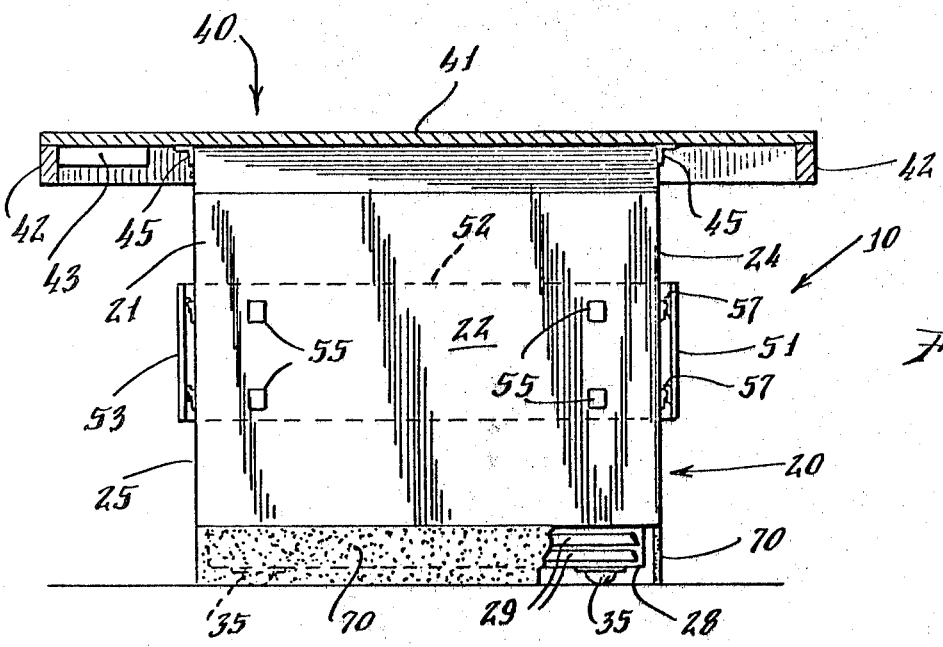
FIG. 3 is a sectional view of the combination food freezer/dining table of FIG. 1 taken along the lines 3—3 of FIG. 1.

The table top 40 is secured to the lid 30 of the food freezer 20, whereby it is supported in a horizontal plane on the lid when the lid is closed and tilts with the lid when the lid is opened, as best seen in FIGS. 1 and 2, respectively. The combination food freezer/dining table 10 is intended for use spaced apart from the walls of a room, and therefore, the table top 40 extends outwardly from all sides of the freezer. The overhang of the table top is preferably at least eight inches and generally in the range of eight to twelve inches from the front and back walls 24 and 25 of the food freezer and may be as large as desired with consideration for the space available. The overhang beyond the end walls 22 and 23 of the food freezer may be somewhat less, for example in the range of six to ten inches. Thus, the overall dimensions of the combination food freezer/dining table 10 may be approximately seventy-two inches by forty-eight inches, which provides a large dining surface.

The table top 40 itself comprises a rectangular panel 41, which may be wood or may be a "sandwich panel" having a foamed or honeycombed core between two skins for high strength and light weight. The table top 40 further comprises an apron 42 depending from the peripheral edge of the rectangular panel 41, thereby giving the table top 40 the appearance of greater thickness and substance. The panel 41 may be secured to the lid 30 of the food freezer by any suitable means, and in FIGS. 3 and 4 it is shown secured by L-brackets 45 which are bolted or riveted to the lid 30 and which are screwed to the panel 41. It is preferable that the securing means for the table top 40 be such that the table top is removable for passing the food freezer through doorways, etc.

It will be appreciated that the table top 40 adds weight to the lid 30 of the food freezer and that the added weight must be compensated for to maintain the normal operation of the lid 30. This can be accomplished in many instances by simply adjusting the springs in the hinge mechanism of the food freezer 20, e.g. the spring force is increased so that the lid 30 and table top 40 are supported in an open position for the insertion and removal of food items from the freezer cavity 26. When required, a weight 43 can be secured to the bottom of the panel 41, inside the apron 42 and spaced apart from the back wall 25 of the food freezer 20. The weight 43 assists in counterbalancing the weight of the table top both when the lid is open and when the lid is closed. The latter condition is governed by the federal regulations which require that the lid can be opened by a maximum force of approximately fifteen to twenty pounds as a safety feature so that children could not be trapped within the freezer by accident.

Figure 4:
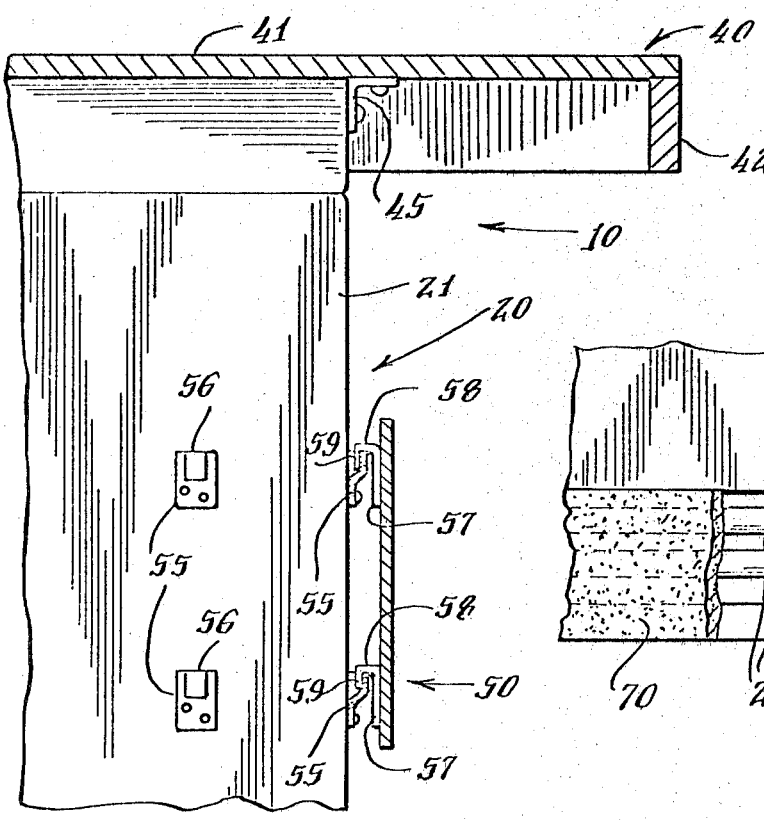
FIG. 4 is a fragmentary end view of the combination food freezer/dining table of FIG. 1 with the knee-barrier removed from the end wall.

The combination food freezer/dining table 10 further comprises peripheral protective knee-barriers 50. The knee-barriers 50 are provided for the comfort of the user at the table and more particularly to prevent the users' knees from contacting the exterior walls of the food freezer 20. These walls become warm as the food freezer is operated because the heat coils of the freezer are placed in close contact with the exterior walls for dissipation of heat. The knee-barriers also enhance the appearance of the combination food freezer/dining table 10. The peripheral protective knee-barrier 50 preferably comprises four individual knee-barriers 51–54, each of the individual knee-barriers being deployed respectively adjacent one of the exterior walls of the food freezer 20. Each of the individual knee-barriers 51–54 comprises an elongated rectangular panel, which may be wood or any other suitable material. The knee-barrier is preferably quite thin to preserve knee room under the table top 40. As best seen in FIG. 4, a plurality of female brackets 55 are secured to the exterior walls of the food freezer 20, and each of these brackets 55 defines an upwardly opening pocket opening 56. Cooperating brackets 57 are secured to the back side of the individual knee-barriers and include a horizontal leg 58 for spacing the knee-barriers away from the exterior walls of the food freezer and a tongue 59 which is received in the pocket opening 56 of the bracket 55. Thus, the individual knee-barriers 51–54 are adapted to be supported adjacent to and spaced apart from the exterior walls of the freezer 20, and to be removed there-from for cleaning the exterior sides of the food freezer and the knee-barriers themselves. Because the knee-barriers are spaced apart from the exterior walls of the freezer, a convection air flow is established between the exterior sides of the freezer and the knee-barriers to provide the requisite heat dissipation. The peripheral protective knee-barrier 50 may be finished to coordinate with the decor established by the table top 40.

Figure 5:
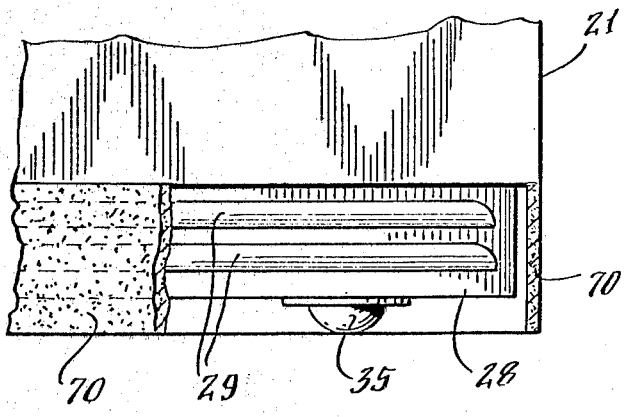
FIG. 5 is a fragmentary view, partially cut away, of the base of the combination food freezer/dining table of FIG. 1.

The combination food freezer/dining table 10 is further provided with an air-pervious base barrier 70. With reference to FIG. 5, the food freezer 20 has a recessed kick plate 28, which may be provided with louvers 29 for exhausting air from the compressor. Additional air flow from the compressor may escape under the kick plate 28, which is spaced apart from the floor so that the food freezer 20 may be moved on its rollers 35. In order to prevent a localized flow of hot air, the air-pervious base barrier 70 is secured to the freezer parallel to and spaced apart from the recessed kick plate 28. The air-pervious base barrier 70 is preferably fabricated of open-celled flexible foam having relatively fine air openings therethrough. Thus, the volume of air from the compressor does not pass through the air-pervious base barrier at a localized area, but is instead evenly distributed about the base of the food freezer 20. The air-pervious base barrier 70 is dimensioned to touch the floor, and the air-pervious base barrier is preferably somewhat flexible so that it may maintain contact with the floor, compensating for irregularities caused by carpeting and the like, and not be bent or broken as the combination food freezer/dining table 10 is moved.

The food freezer/dining table 10, as an example, may have a top finished in butcherblock style plastic laminate, and the peripheral protective knee-barrier may also be finished with a matching butcherblock style plastic laminate to provide a coordinated design. The exterior walls of the food freezer may be provided with a finish somewhat different than the conventional appliance finishes, as desired for aesthetic reasons.

Figure 6:
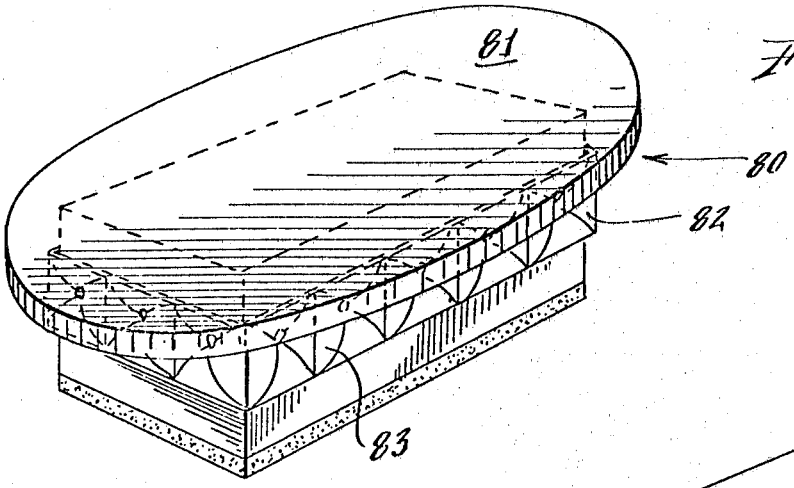
FIG. 6 is a perspective view of another combination food/freezer dining table according to the invention herein.

With reference to FIG. 6, another combination food freezer/dining table 80 according to the invention herein is shown. It differs from the combination food freezer/dining table 10 described above it that its table top 81 is oval in configuration and also in that its peripheral protective knee-barrier 82 is provided with a padded vinyl face 83. This illustrates how combination food freezers/dining tables according to the invention herein can be adapted for different style and decor.

Figure 7:
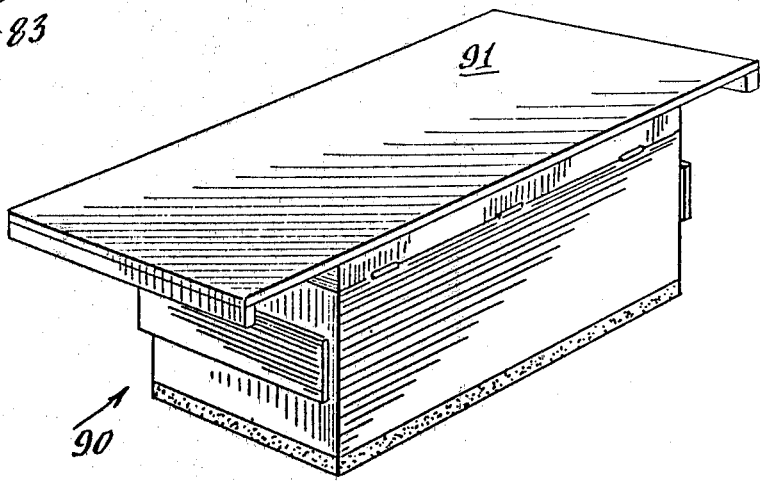

Another combination food freezer/dining table 90 according to the invention herein is shown in FIG. 7. It will be noted that its table top 91 overhangs the food freezer on three sides only, and does not overhang the food freezer at its back side where the lid is hinged to the freezer body. Thus, the combination food freezer/-dining table 90 is adapted to be placed against the wall and to accommodate diners on three sides thereof. It will be appreciated that the table top could also be designed to overhang the freezer on only one side or on only two sides, as desired for the particular room in which the combination food freezer/dining table is to be used.

Figure 8:
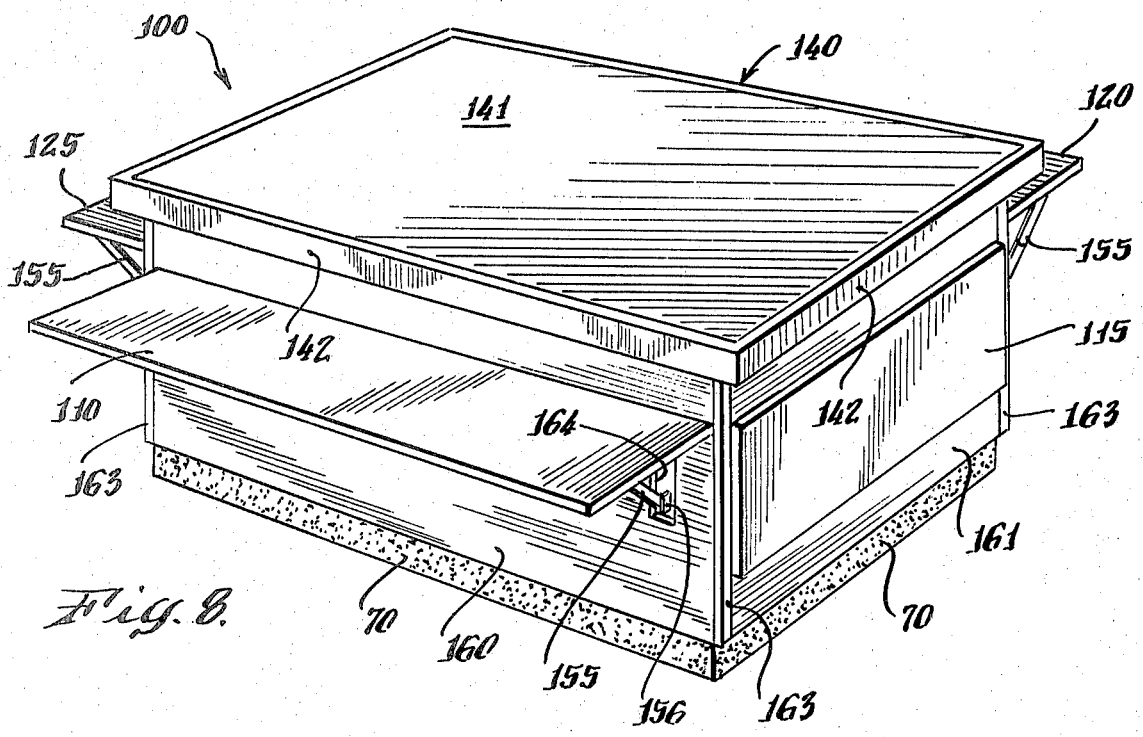
FIG. 8 is a perspective view of another combination food freezer/dining table according to the invention herein.
Figure 9:
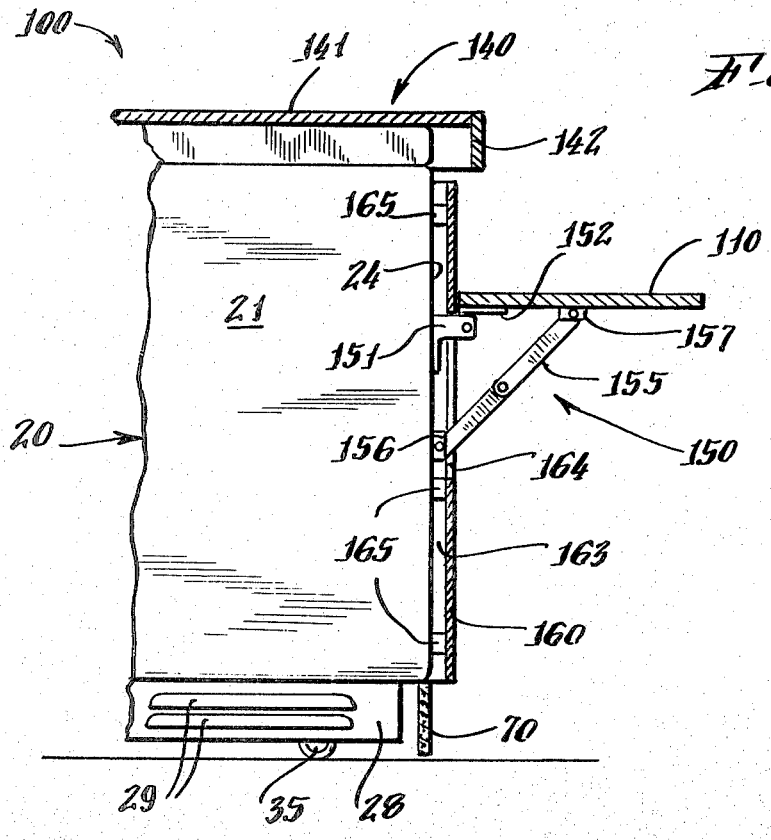
FIG. 9 is a fragmentary sectional view of the food freezer/dining table of FIG. 9.

With reference to FIGS. 8 and 9, there is illustrated a combination food freezer/dining table 100 which is another embodiment of the invention herein. The food freezer/dining table 100 generally comprises a food freezer 20 having a freezer body 21 and lid 30, and a plurality of table leaves 110, 115, 120 and 125 respectively hingedly mounted to the side walls of the freezer body and pivotal between an operative position extending horizontally outwardly from the freezer body and a storage position vertically adjacent to the freezer body. A table top 140 may be secured to the freezer lid with a small overhang. The dining surface of the food freezer/dining table 100 is provided by the leaves in their horizontal operative oposition and the table top 140 provides a central serving area. The table leaves 110 preferably extend approximately 30 inches outwardly from the secondary side wall 160, which provides an adequate dining surface.

With reference to FIG. 9, the construction of the food freezer/dining table 100 is shown in more detail. The table leaf 110 is mounted to side wall 24 of the freezer body 21 by means of a hinge mechanism generally indicated at 150. The hinge mechanism includes two pivotally-connected hinge brackets 151 and 152, the first of which is fastened to the freezer wall 24 and the second of which is secured to the underside of the table leaf 110. A folding strut 155 has one end secured to the freezer wall at 156, and has its other end secured to the underside of the table leaf 110 at 157. The folding strut 155 is made of two pivotally connected links. It "locks" in its extended position to support the table leaf 110 in its horizontal operative position, and it folds to permit the table leaf 110 to pivot to its storage position in which it is vertically oriented adjacent to the freezer wall, such as is illustrated by the position of table leaf 115 in FIG. 8. There are two hinge mechanisms 150 per table leaf, one near each end thereof. The other table leaves 115, 120 and 125 are similarly respectively mounted to the other freezer side walls.

The freezer body 21 is also provided with secondary side walls, only two of which, designated by reference numerals 160 and 161, are seen in FIG. 8. With reference to FIG. 9, the secondary side wall 160 is mounted spaced apart from the freezer side wall 24 on mounting blocks 165. The mounting blocks may be either small individual blocks or vertically oriented strips, whereby in either event air flow is permitted between the freezer side wall 24 and the secondary side wall 160. A corner post 163 (FIG. 8) joins the secondary side walls 160, 161 at the corner of the freezer body. The secondary side walls function to prevent contact between the user's knees and the freezer side wall, and also provide a decorative function in that the secondary side walls can have a grained wood surface or the like. The secondary side walls are slotted, e.g., slot 164 in secondary side wall 160, to provide the clearance for the hinge mechanism 150 and particularly the folding strut 155.

The table top 140 may be secured to the freezer lid 30 by any suitable means, including brackets, the table top 140 may include a top panel 141 and a vertically depending skirt 142, wherein the skirt slightly overhangs the secondary side wall 160 to provide a grip for lifting the freezer lid and also for concealing the top opening of the space between the secondary side walls and the freezer side walls.

The base of the combination food freezer/dining table 100 may be provided with an air-pervious base barrier 70 as described above.

It will be appreciated that the structure shown in FIG. 9, i.e., the table leaf 110, hinge mechanism 150 and secondary side wall 160 is also present on the additional sides of the food freezer/dining table 100, as desired, and that the particular type of hinge mechanism is not a limiting feature of the invention herein.

Accordingly, there have been described above combination food freezers/dining tables which admirably achieve the objects of the invention herein, and in particular, adapt food freezers for efficient space utilization. It will be appreciated that various changes and modifications may be made from the preferred embodiments described above by those skilled in the art without departing from the spirit and scope of the invention herein, which is limited only by the following claims.

I claim:

1. A combination food freezer/dining table comprising:

(A) a chest-type food freezer including a body having exterior end walls and exterior front and back walls, interior walls defining an open topped cavity for accepting food items and a lid connected by a hinge mechanism to the body adjacent the exterior back wall thereof, the lid pivotal between an open position permitting access to the cavity and a closed position in which the lid is disposed horizontally on the body covering the open top of the cavity; and (B) table means secured to the food freezer and extending outwardly with respect to at least one side thereof, whereby the food freezer is adapted for use as a dining table with a user's knees accommodated under the outwardly extending table means when the user is seated at the combination food freezer/dining table, the table means including at least one table leaf hingedly mounted to one of the exterior walls of the food freezer body via a hinge mechanism and including means for supporting the table leaf in its horizontal operative position, the table leaf being pivotal to a storage position adjacent the exterior wall.

2. A combination food freezer/dining table as defined in claim 1 and further comprising:

(C) an air-pervious base barrier mounted to the freezer and extending between the exterior walls of the food freezer and the floor surface on which the food freezer is supported, the air-pervious barrier providing for restricted air passage therethrough to evenly disperse air flow created by operation of the food freezer.

3. A combination food freezer/dining table as defined in claim 1 wherein one table leaf is hingedly mounted to each side wall of the food freezer body.

4. A combination food freezer/dining table as defined in claim 3 wherein the table leaves extend outwardly about 30" in their horizontal operative positions.

5. A combination food freezer/dining table as defined in claim 16 and further comprising secondary side walls mounted spaced apart from and substantially covering the food freezer side walls, whereby air may circulate between the food freezer side walls and the secondary side walls and the secondary side walls prevent the user's knees from contacting the food freezer side walls.

6. A combination food freezer/dining table as defined in claim 5 wherein the table means further comprises a table top secured to the freezer lid and overhanging the secondary side walls.

7. A combination food freezer/dining table comprising:

(A) a chest-type food freezer including a body having exterior end walls and exterior front and back walls, interior walls defining an open topped cavity for accepting food items and a lid connected by a hinge mechanism to the body adjacent the exterior back wall thereof, the lid pivotal between an open position permitting access to the cavity and a closed position in which the lid is disposed horizontally on the body covering the open top of the cavity;

(B) a table top secured to the lid of the food freezer and overhanging the lid and at least the exterior front and end walls of the food freezer, the table top also being disposed horizontally when the lid is in its closed position; and (C) a peripheral protetive knee-barrier removably secured to and spaced apart from each of the exterior walls of the food freezer that the table top overhangs, the peripheral knee-barrier preventing contact between the user's knees and the exterior walls of the food freezer and the knees of a user sitting at the combination food freezer/dining table and permitting air flow between the knee-barrier and exterior walls of the food freezer, whereby the food freezer is adapted for use as a dining table with the user's knees accommodated under the overhanging table top when the user is seated at the combination food freezer/dining table.

8. A combination food freezer/dining table as defined in claim 7 and further comprising:

(D) an air-pervious base barrier mounted to the freezer and extending between the exterior walls of the food freezer and the floor surface on which the food freezer is supported, the air-pervious barrier providing for restricted air passage therethrough to evenly disperse air flow created by operation of the food freezer.

9. A combination food freezer/dining table as defined in claim 7 wherein the table top overhangs all four exterior walls of the food freezer.

10. A combination food freezer/dining table as defined in claim 7 wherein the table top is rectangular and overhangs the front and back exterior walls of the food freezer in the range of eight to twelve inches and overhangs the exterior end walls of the food freezer in the range of six to ten inches.

11. A combination food freezer/dining table as defined in claim 7 wherein each of the knee-barriers is removably secured to the food freezer.

12. A combination food freezer/dining table as defined in claim 7 wherein each of the knee-barriers is removably secured to the food freezer by a plurality of female brackets secured to the exterior walls of the food freezer, each of the female brackets defining an open topped pocket, and an equal plurality of cooperating brackets secured to the knee-barriers including a tongue portion removably received in the pockets of the female brackets.

* * * * *